United States Patent [19]

Aoki et al.

[11] Patent Number: 4,500,635

[45] Date of Patent: Feb. 19, 1985

[54] COLOR PHOTOGRAPHIC SILVER HALIDE LIGHT-SENSITIVE MATERIAL

[75] Inventors: Kozo Aoki; Akira Ogawa; Osami Tanabe, all of Kanagawa, Japan

[73] Assignee: Fuji Photo Film Co., Ltd., Kanagawa, Japan

[21] Appl. No.: 589,294

[22] Filed: Mar. 14, 1984

[30] Foreign Application Priority Data

Mar. 14, 1983 [JP] Japan ..... 58-42671

[51] Int. Cl.[3] ..... G03C 7/26

[52] U.S. Cl. ..... 430/552; 430/384; 430/385; 430/553

[58] Field of Search ..... 430/384, 385, 552, 553

[56] References Cited

U.S. PATENT DOCUMENTS

| | | | |
|---|---|---|---|
| 4,362,810 | 12/1982 | Usagawa et al. | 430/553 |
| 4,368,257 | 1/1983 | Usagawa et al. | 430/553 |
| 4,427,767 | 1/1984 | Aoki et al. | 430/552 |
| 4,458,012 | 7/1984 | Ito et al. | 430/553 |

FOREIGN PATENT DOCUMENTS 2098600 11/1982 United Kingdom .

*Primary Examiner*—J. Travis Brown

*Attorney, Agent, or Firm*—Sughrue, Mion, Zinn, Macpeak and Seas

[57] ABSTRACT

A color photographic silver halide light-sensitive material is described. The material includes a cyan coupler represented by the general formula (I):

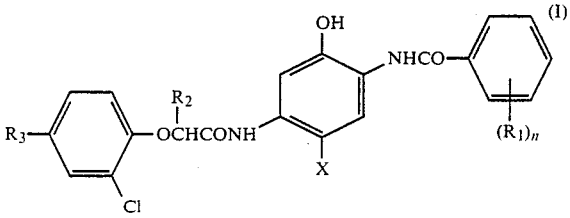

(the symbols are as described in the claims). This coupler is easily soluble in high boiling organic solvents, exhibits a high dye-forming rate in developers, and furthermore, provides color images of high fastness.

12 Claims, No Drawings

COLOR PHOTOGRAPHIC SILVER HALIDE LIGHT-SENSITIVE MATERIAL

FIELD OF THE INVENTION

The present invention relates to a color photographic silver halide light-sensitive material containing novel cyan dye-forming couplers.

BACKGROUND OF THE INVENTION

When a color photographic silver halide light-sensitive material (hereinafter sometimes referred to merely as a "light-sensitive material") is exposed to light and then color-developed, an oxidized aromatic primary amine developing agent reacts with a dye-forming coupler to form a color image. In this method, color reproduction is usually achieved by the subtractive color process; that is, for reproduction of blue, green and red, dyes of cyan, magenta and yellow in complementary relation to red, green and blue, respectively, are formed.

Phenols and naphthols are widely used as cyan dye-forming couplers. Conventional phenols and naphthols, however, have a disadvantage in that color images derived therefrom are inferior in storage stability. For example, color images derived from a 2-acylaminophenol cyan coupler described in U.S. Pat. Nos. 2,367,531 and 2,423,730 are generally inferior in heat-fastness. Color images derived from a 2,5-diacylaminophenol cyan coupler described in U.S. Pat. Nos. 2,369,929 and 2,772,162 are generally inferior in light-fastness. A 1-hydroxy-2-naphthamide cyan coupler can provide only color images which are generally inferior in both light-fastness and heat-fastness.

It is said that a 2,5-diacylaminophenol cyan coupler described in U.S. Pat. No. 4,124,396, Japanese Patent Application (OPI) Nos. 155538/82 and 157246/82 (the term "OPI" as used herein refers to a "published unexamined Japanese patent application"), etc., is improved over the above-described commonly used cyan couplers in respect of fastness and solubility in high boiling organic solvents. This improvement, however, is not sufficiently satisfactory; the cyan coupler can provide only color images which cannot be stored stably for long periods of time and when added to photographic emulsions, it is likely to crystallize. Furthermore, the cyan coupler has a disadvantage of being expensive; that is, the phenol compound to be reacted with α-halocarboxylic acid or its ester to form a ballast group is not commercially available and requires some reaction steps for the synthesis thereof, resulting in an increase in production costs.

SUMMARY OF THE INVENTION

An object of the invention is to provide a color photographic silver halide light-sensitive material containing cyan dye-forming couplers which can provide color images of high fastness and further are easily soluble in high boiling organic solvents.

Another object of the invention is to provide a coupler which exhibits a high dye-forming rate in color developers, specifically a sufficiently high dye-forming rate even in developers containing no benzyl alcohols, and which provides a high maximum color density.

A further object of the invention is to provide an unexpensive coupler which can provide color images, the density of which hardly drops even when treated with bleaching solutions of low oxidizing power or with fatigued bleaching solutions.

It has been found that the objects are attained by using the compounds represented by the general formula (I) as described hereinafter.

The present invention relates to a color photographic silver halide light-sensitive material containing a cyan dye-forming coupler represented by the general formula (I) as described hereinafter.

DETAILED DESCRIPTION OF THE INVENTION

The cyan dye-forming couplers as used herein are represented by the following general formula (I):

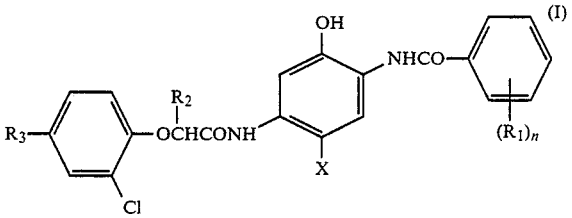

wherein $R_1$ is a hydrogen atom, a halogen atom (e.g., a fluorine atom, a chlorine atom, and a bromine atom), a chain-like alkyl group having 1 to 20 carbon atoms (e.g., a methyl group, an ethyl group, and a butyl group), or an alkoxy group having 1 to 20 carbon atoms (e.g., a methoxy group, an ethoxy group, and a tetradecyloxy group), and may be linked to the benzene nucleus at any of orhto-, meta- and para-positions;

$R_2$ is an alkyl group having 1 to 20 carbon atoms (e.g., a methyl group, an ethyl group, a butyl group, a dodecyl group and an octadecyl group);

$R_3$ is a hydrogen atom, a halogen atom (e.g., a chlorine atom), or an alkyl group (e.g., a methyl group and a hexyl group);

X is a hydrogen atom, a halogen atom (e.g., a fluorine atom, a chlorine atom and a bromine atom), an alkoxy group having 1 to 32 carbon atoms (e.g., an ethoxy group, a dodecyloxy group, a carboxymethoxy group and a methylsulfonylethoxy group), an aryloxy group having 6 to 32 carbon atoms (e.g., a phenoxy group, a naphthyloxy group and a 4-carboxyphenoxy group), an acyloxy group having 1 to 32 carbon atoms (e.g., an acetoxy group, a tetradecanoyloxy group and a benzoyloxy group), a sulfonyloxy group (e.g., a methanesulfonyloxy group and a toluenesulfonyloxy group), an amido group (e.g., a dichloroacetylamino group, a heptafluorobutyrylamino group, a methanesulfonylamino group and a toluenesulfonylamino group), an alkoxycarbonyloxy group having 2 to 33 carbon atoms (e.g., an ethoxycarbonyloxy group), an aryloxycarbonyloxy group having 7 to 33 carbon atoms (e.g., a phenoxycarbonyloxy group), or an imido group (e.g., a succinimido group and a hydantoinyl group); and n is an integer of 1 or 2.

In the general formula (I), $R_1$ is preferably a hydrogen atom, a halogen atom, a methyl group and a methoxy group.

$R_1$ is preferably in the ortho-position, except for a case in which it is a hydrogen atom.

$R_2$ preferably has 8 to 20 carbon atoms.

$R_3$ is preferably a hydrogen atom, a halogen atom, or a methyl group, and more preferably a hydrogen atom or a chlorine atom. Especially preferred is a hydrogen atom.

X is preferably a hydrogen atom or a chlorine atom.

n is preferably 1.

Typical examples of the cyan couplers of the general formula (I) are shown below although the present invention is not limited thereto.

(1)

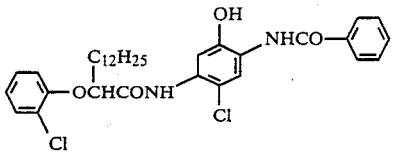

(2)

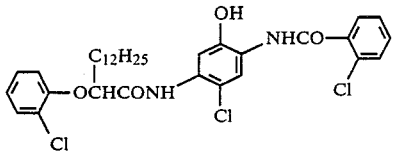

(3)

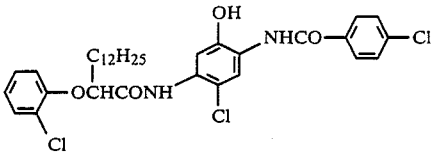

(4)

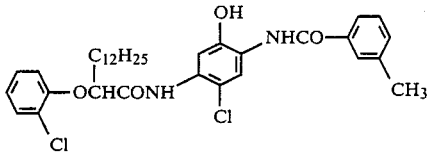

(5)

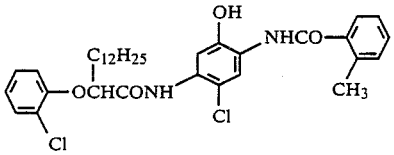

(6)

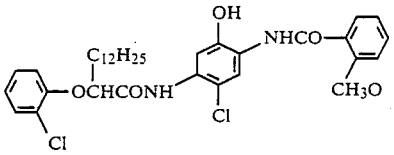

(7)

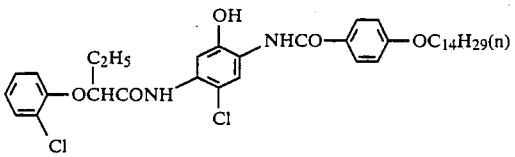

(8)

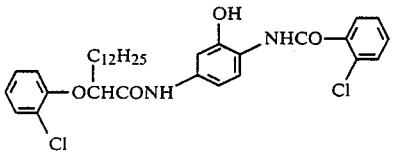

(9)

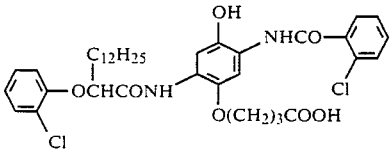

-continued (10)

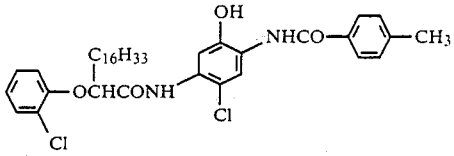

(11)

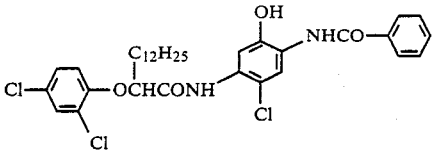

(12)

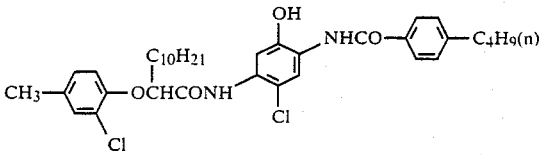

(13)

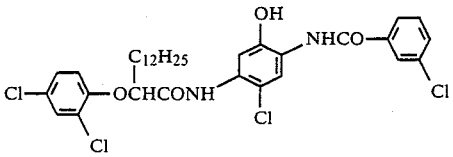

(14)

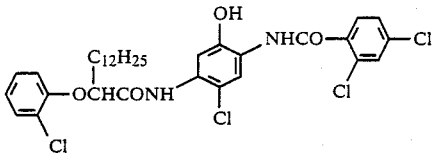

The cyan couplers of the general formula (I) can be synthesized by the following reaction steps:

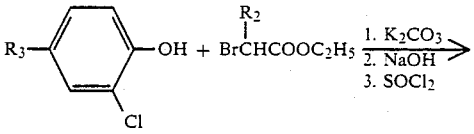

Formula (II)

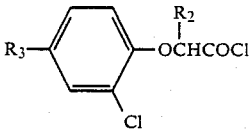

Compound (A)

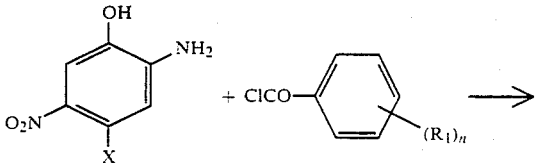

-continued

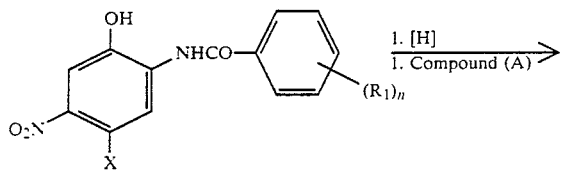

Compound (B)

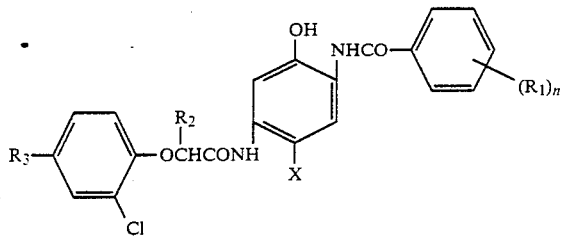

Formula (I)

Compound (A) is first synthesized using a phenol compound represented by the formula (II), which is easily available and is inexpensive, according to the reaction as described above. This Compound (A) is then reacted with a reduced product of Compound (B) prepared from a 2-amino-5-nitrophenol derivative to form a coupler of the present invention as represented by the formula (I).

A typical preparation example is shown below.

PREPARATION EXAMPLE

This example is directed to the synthesis of Coupler (2) as described above.

(1) Preparation of Compound (A) ($R_3$=H)

A mixture of 20.3 g of orthochlorophenol and 51.6 g of ethyl α-bromotetradecanoate was dissolved in 780 ml of dimethylformamide, and 26.0 g of anhydrous potassium carbonate was added thereto. They were heated for 2 hours on a steam bath while stirring. The reaction mixture was cooled and then ethyl acetate was added thereto. The mixture was washed twice with water. The solvents were distilled away under reduced pressure. Then, a solution of 120 ml of methanol and 9.3 g of sodium hydroxide in 15 ml of water was added, and the resulting mixture was heated for 1 hour while stirring. The reaction mixture was cooled and then 60 ml of water was added thereto. On making the mixture acid by adding hydrochloric acid, crystals precipitated. These crystals were collected to obtain 52.3 g of crystals, m.p.: 56° to 63° C. Then, 28.3 g of the crystals was dissolved in 85 ml of benzene, and 11 ml of thionyl chloride was added dropwise while heating at reflux. The resulting mixture was then heated at reflux for 1 hour. At the end of the time, excessive reagents were distilled away under reduced pressure, whereupon 29.8 g of Compound (A) ($R_3$=H) was obtained.

(2) Preparation of Compound (B)

2-Amino-4-chloro-5-nitrophenol (37.2 g) was suspended in 200 ml of acetonitrile, and 35.6 g of o-chlorobenzoyl chloride was added dropwise over 1 hour while heating the suspension at reflux. The resulting mixture was heated at reflux for an additional 1 hour. The reaction mixture was cooled, and crystals precipitated were collected to obtain 53 g of Compound (B).

This Compound (B) was mixed with 36 g of reduced iron, 3 g of ammonium chloride, 160 ml of isopropanol, and 20 ml of water, and heated at reflux for 1 hour. The reaction mixture was cooled and then a solution of 14 g of sodium hydroxide in 70 ml of water was added thereto. The iron powder was removed by filtration. On neutralizing the filtrate with acetic acid, crystals precipitated. When these crystals were collected by filtration and dried, they weighed 45 g. Then, 23 g of the crystals was suspended in 100 ml of acetonitrile, and 29.8 g of Compound (A) was added dropwise to the suspension while heating at reflux. After addition of Compound (A), the resulting mixture was refluxed for 1 hour while stirring and then cooled. Crystals precipitated were collected by filtration and then recrystallized from 50 ml of ethyl acetate and 120 ml of acetonitrile to obtain 29.1 g of Coupler (2), m.p.: 114°–115° C.

Other couplers as described above can be prepared in the same manner as described above. The melting points of typical couplers are shown below.

| | m.p. (°C.) |
|---|---|
| Coupler (1) | 121–123 |
| Coupler (4) | 104–106 |
| Coupler (5) | 104–106 |
| Coupler (11) | 144–146 |

Photographic emulsions prepared by the present invention may contain dye-forming couplers in addition to the cyan couplers of the present invention.

These couplers are preferably non-diffusing ones containing a hydrophobic group called a ballast group in the molecule. The couplers may be 4-equivalent or 2-equivalent relative to silver ions. Colored couplers having the effect of color correction, or so-called DIR couplers releasing a development inhibitor with development may be contained. The couplers may be those providing colorless coupling reaction products.

Known open chain ketomethylene-based couplers can be used as yellow couplers. Of these open chain ketomethylene-based couplers, benzoylacetanilide and pivaloylacetanilide-based compounds can be used advantageously. Suitable examples of yellow couplers which can be used are described in, for example, U.S. Pat. Nos. 2,875,057, 3,265,506, 3,408,194, 3,551,155, 3,582,322, 3,725,072, 3,891,445, West German Pat. No. 1,547,868, West German Patent Application Laid-Open Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77.

Pyrazolone-based compounds, indazolone-based compounds, cyanoacetyl compounds, etc., can be used as magenta couplers. Particularly advantageous ones are pyrazolone-based compounds. Suitable examples of magenta couplers which can be used are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Phenol-based compounds, naphthol-based compounds, etc., can be used as cyan couplers. Suitable examples are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77 and 90932/77.

As colored couplers can be used the compounds described in, for example, U.S. Pat. Nos. 3,476,560, 2,521,908, 3,034,892, Japanese Patent Publication Nos. 2016/69, 22335/63, 11304/67 corresponding to U.S. Pat. No. 3,481,741, 32461/69 corresponding to U.S. Pat. No. 3,583,971, Japanese Patent Application (OPI) Nos. 26034/76 corresponding to U.S. Pat. No. 4,138,258, 42121/77 and West German Patent Application (OLS) No. 2,418,959.

As DIR couplers can be used the compounds described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Pat. No. 953,454, Japanese Patent Application (OPI) Nos. 69624/77, 122335/74 and Japanese Patent Publication No. 16141/76.

In addition to DIR couplers, compounds releasing a development inhibitor with development may be incorporated in light-sensitive materials. For example, the compounds described in U.S. Pat. Nos. 3,297,445, 3,379,529, West German Patent Application (OLS) No. 2,417,914, Japanese Patent Application (OPI) Nos. 15271/77 and 9116/78.

Two or more of the couplers of the present invention can be incorporated in the same layer in combination with the above-described couplers. The same compound can be incorporated in two or more layers.

The amount of the couplers of the present invention being added is usually from $2\times10^{-3}$ to $5\times10^{-1}$ mole per mole of silver contained in the emulsion layer, with the range of from $1\times10^{-2}$ to $5\times10^{-1}$ mole being preferred.

The above-described couplers can be introduced in silver halide emulsion layers or intermediate layers by known procedures such as the method described in U.S. Pat. No. 2,322,027. For example, the coupler is dissolved in phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azelate), phenols (e.g., 2,4-di-tert-amylphenol), or organic solvents having a boiling point ranging between about 30° and 150° C., such as lower alkyl acetates (e.g., ethyl acetate and butyl acetate), ethyl propionate, sec-butyl alcohol, methyl isobutyl ketone, β-ethoxyethyl acetate and methyl cellosolve acetate, and then dispersed in hydrophilic colloids. The above-described high boiling and low boiling organic solvents may be used in combination with each other.

In addition, the dispersion process utilizing polymeric compounds as described in Japanese Patent Publication No. 39853/76 and Japanese Patent Application (OPI) No. 59943/76 can be used.

When couplers contain acid groups such as a carboxylic acid and a sulfonic acid, they are introduced in the hydrophilic colloids in the form of alkaline aqueous solutions.

The light-sensitive material of the present invention may contain ultraviolet absorbers in the hydrophilic colloid layer thereof. Ultraviolet absorbers which can be used include benzotriazole compounds substituted by an aryl group (e.g., the compounds described in U.S. Pat. No. 3,533,794), 4-thiazolidone compounds (e.g., the compounds described in U.S. Pat. Nos. 3,314,794 and 3,352,681), benzophenone compounds (e.g., the compounds described in Japanese Patent Application (OPI) No. 2784/71), cinnamic acid esters (e.g., the compounds described in U.S. Pat. Nos. 3,705,805 and 3,707,375), butadiene compounds (e.g., the compounds described in U.S. Pat. No. 4,045,229), and benzoxazole compounds (e.g., the compounds described in U.S. Pat. No. 3,700,455). In addition, the compounds described in U.S. Pat. No. 3,499,762 and Japanese Patent Application (OPI) No. 48535/79 can be used. Ultraviolet ray-absorbing couplers (e.g., α-naphthol-based cyan dye-forming couplers), ultraviolet ray-absorbing polymers, etc., may be used. These ultraviolet absorbers may be mordanted to a specific layer.

In photographic emulsion layers of the light-sensitive material of the present invention may be incorporated polyalkylene oxide or its ether, ester and amine derivatives, thioether compounds, thiomorpholines, quaternary ammonium salt compounds, urethane derivatives, urea derivatives, imidazole derivatives, 3-pyrazolidones, etc., for the purpose of increasing sensitivity or contrast, or of accelerating development. Compounds as described in, for example, U.S. Pat. Nos. 2,400,532, 2,423,549, 2,716,062, 3,617,280, 3,772,021, 3,808,003 and British Pat. No. 1,488,991 can be used for this purpose.

Photographic emulsion layers as used herein may be subjected to spectral sensitization using, for example, methine dyes. Dyes which can be used include cyanine dye, merocyanine dye, composite cyanine dye, composite merocyanine dye, holopolar cyanine dye, hemicyanine dye, styryl dye, and hemioxonol dye. Especially useful are those dyes belonging to cyanine dyes, merocyanine dyes and composite merocyanine dyes. In these dyes, any nuclei which are ordinarily utilized for cyanine dyes as basic heterocyclic nuclei can be applied. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from fusion of aliphatic hydrocarbon rings to the above-described nuclei; and nuclei resulting from fusion of aromatic hydrocarbon rings to the above-described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These nuclei may be substituted in a carbon atom thereof.

In merocyanine dye or composite merocyanine dye, as nuclei having the ketomethylene structure, 5- or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus can be applied.

Useful sensitizing dyes are those compounds as described in, for example, German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Pat. No. 1,242,588, Japanese Patent Publication Nos. 14030/69 and 24844/77.

These sensitizing dyes may be used singly or in combination with each other. Such combinations of sensitizing dyes are often used for the purpose of supersensitization. Typical examples of the sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77 and 109925/77.

Dyes not having a spectral sensitization action by themselves or substances not materially absorbing visible light, but exhibiting supersensitization may be incorporated in photographic emulsions in combination with sensitizing dyes as described above. For example, aminostilbene compounds substituted by a nitrogen-containing heterocyclic group (as described in, for example, U.S. Pat. Nos. 2,933,390 and 3,635,721), aromatic organic acid/formaldehyde condensates (as described in, for example, U.S. Pat. Nos. 3,743,510), cadmium salts, and azaindene compounds may be incorporated. Especially useful are the combinations described in U.S. Pat. Nos. 3,615,613, 3,615,641, 3,617,295 and 3,635,721.

The light-sensitive material of the present invention may contain water-soluble dyes in hydrophilic colloid layers thereof as filter dyes or for various purposes, for example, prevention of irradiation. Water-soluble dyes which can be used include oxonol dye, hemioxonol dye, styryl dye, merocyanine dye, cyanine dye and azo dye. Especially useful are oxonol dye, hemioxonol dye and merocyanine dye. Representative examples of dyes which can be used are the ones described in British Pat. Nos. 584,609, 1,177,429, Japanese Patent Application (OPI) Nos. 85130/73, 99620/74, 114420/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

The light-sensitive material of the present invention may contain whiteners such as stilbene, triazine, oxazole or cumarine-based whiteners in hydrophilic colloid layers such as photographic emulsion layers thereof. These whiteners may be water-soluble, or water-insoluble whiteners may be used in the form of dispersions. Typical examples of fluorescent whiteners are described in U.S. Pat. Nos. 2,632,701, 3,269,840, 3,359,102, British Pat. Nos. 852,075 and 1,319,763.

In the practice of the present invention, known anti-fading agents as described hereinafter can be used in combination. Color image stabilizers as used herein may be used singly or as mixtures comprising two or more thereof.

Known anti-fading agents include hydroquinone derivatives as described in U.S. Pat. Nos. 2,360,290, 2,418,613, 2,675,314, 2,701,197, 2,704,713, 2,728,659, 2,732,300, 2,735,765, 2,710,801, 2,816,028, and British Pat. No. 1,363,921, gallic acid derivatives described in U.S. Pat. Nos. 3,457,079 and 3,069,262, p-alkoxyphenols described in U.S. Pat. Nos. 2,735,765, 3,698,909, Japanese Patent Publication Nos. 20977/74 and 6623/77, p-oxyphenol derivatives described in U.S. Pat. Nos. 3,432,300, 3,573,050, 3,574,627, 3,764,337, Japanese Patent Application (OPI) Nos. 35633/77, 147434/77 and 152225/77, and bisphenols described in U.S. Pat. No. 3,700,455.

The light-sensitive material of the present invention may contain hydroquinone derivatives, aminophenol derivatives, gallic acid derivatives, ascorbic acid derivatives, etc., as anti-color-foggants. Representative examples are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, and Japanese Patent Publication No. 23813/75.

The present invention can be applied to multilayer polychromatic photographic materials comprising a support and at least two layers having different spectral sensitivities. Multilayer natural color photographic materials usually bear at least one red-sensitive emulsion layer, at least one green-sensitive emulsion layer and at least one blue-sensitive emulsion layer on a support. The order in which the layers are provided is not critical and can be determined at will. Usually the red-sensitive emulsion layer contains a cyan coupler, the green-sensitive emulsion layer, a magenta coupler, and the blue-sensitive emulsion layer, a yellow coupler. In some cases, however, different combinations may be employed.

For photographic processing of the light-sensitive material of the present invention, any of the known procedures can be employed and known processing solutions can be used. The processing temperature is usually chosen within the range of from 18° to 50° C., but lower temperatures than 18° C. and higher temperatures than 50° C. can also be used. Either a black-and-white photographic treatment to form a silver image or a color photographic treatment involving a developing treatment to form a dye image can be employed.

A color developer is usually an alkaline aqueous solution containing a color developing agent. As these color developing agents, known primary aromatic amine developers such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline and 4-amino-3-methyl-N-ethyl-N-$\beta$-methoxyethylaniline) can be used. In addition, the compounds described in, for example, L. F. A. Mason, *Photographic Processing Chemistry,* published by Focal Press Co., pages 226–229 (1966), U.S. Pat. Nos. 2,193,015, 2,592,364, and Japanese Patent Application (OPI) No. 64933/73 can be used.

The color developer can further contain pH buffers (e.g., sulfites, carbonates, borates and phosphates of alkali metals), and development inhibitors or anti-foggants (e.g., bromides, iodides and organic anti-foggants). If desired, it may contain hard water-softening agents, preservatives (e.g., hydroxylamine), organic solvents (e.g., benzyl alcohol and diethylene glycol), development accelerators (e.g., polyethylene glycol, quaternary ammonium salts, and amines), dye-forming couplers, competitive couplers, foggants (e.g., sodium borohydride), auxiliary developing agents (e.g., 1-phenyl-3-pyrazolidone), tackifiers, the polycarboxylic acid-based chelating agents described in U.S. Pat. No. 4,083,723, and the antioxidants described in West German Patent Application (OLS) No. 2,622,950.

After being color-developed, the photographic emulsion layer is usually bleached. This bleaching treatment may be performed simultaneously with a fixing treatment, or they may be performed separately. Bleaching agents which can be used include multivalent metal (e.g., iron (III), cobalt (III), chromium (VI) and copper (II))-containing compounds, peracids, quinones, and nitroso compounds. For example, ferricyanides, perchromates, organic complex salts of iron (III) or cobalt (III), such as complex salts of aminopolycarboxylic acids (e.g., ethylenediaminetetraacetic acid, nitrilotriacetic acid, and 1,3-diamino-2-propanoltetraacetic acid) or organic acids (e.g., citric acid, tartaric acid, and malic acid), persulfates, permanganates and nitrosophenol can be used. Of these compounds, potassium ferricyanide, iron (III) sodium ethylenediaminetetraacetate, and iron (III) ammonium ethylenediaminetetraacetate are especially useful. Ethylenediaminetetraacetic acid/iron (III) complex salts are useful in both an independent bleaching solution and a combined bleaching and fixing bath.

To these bleaching or bleach-fixing solutions can be added various additives such as the bleach accelerators described in U.S. Pat. Nos. 3,042,520, 3,241,966, Japanese Patent Publication Nos. 8506/70 and 8836/70, and the thiol compounds described in Japanese Patent Application (OPI) No. 65732/78.

The present invention is described in greater detail with reference to the following examples, although it is not limited thereto.

EXAMPLE 1

A mixture of 10 g of Coupler (1) of the present invention, 10 ml of trioctyl phosphate, and 20 ml of ethyl acetate was heated at 50° C. to form a solution. This solution was added to 100 ml of an aqueous solution containing 10 g of gelatin and 0.4 g of sodium dodecylbenzenesulfonate. The resulting mixture was stirred and then finely emulsified and suspended by passing through a colloid mill.

All the emulsion as prepared above was added to 400 g of a photographic emulsion containing 21 g of silver chlorobromide and 24 g of gelatin, and 30 ml of a 2% aqueous solution of 4,6-dichloro-4-hydroxytriazine was added thereto. The resulting mixture was adjusted to pH 6.0 and uniformly coated on a triacetate fiber film base. The thus prepared material is called "Sample A".

Materials, Samples B, C and D, were prepared using the same molar amount and in the same manner as above except that Coupler (1) was replaced by Couplers (2), (5) and (11), respectively.

For comparison, a film material was prepared using the same molar amount and in the same manner as described above wherein Comparative Coupler (101) having the formula as described hereinafter was used in place of Coupler (1). This material is called "Sample E".

Comparative Coupler (101) (as described in Japanese Patent Application (OPI) No. 157246/82 corresponding to British Pat. No. 2,098,600)

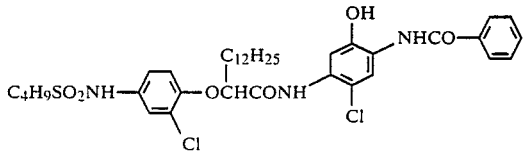

Each film material was continuously exposed to light through a wedge for sensitometry and then processed as follows:

| Step | Temperature (°C.) | Time (sec) |
|---|---|---|
| 1. Color Development | 36 | 180 |
| 2. Stopping | 25–30 | 40 |
| 3. First Fixing | 25–30 | 40 |
| 4. Bleaching | 25–30 | 60 |
| 5. Second Fixing | 25–30 | 40 |
| 6. Rinsing | 25–30 | 30 |

The composition of the treating solution used at each step was as follows:

| | Amount (g) |
|---|---|
| Color Developer | |
| Sodium Sulfite | 5.0 |
| 4-Amino-3-methyl-N,N—diethylaniline | 3.0 |
| Sodium Carbonate | 20.0 |
| Potassium Bromide | 2.0 |
| Water to make | 1 liter (pH: 10.5) |
| Stopping Solution | |
| Sulfuric Acid (6 N) | 50.0 ml |
| Water to make | 1 liter (pH: 1.0) |
| Fixing Solution | |
| Ammonium Thiosulfate | 60.0 |
| Sodium Sulfite | 2.0 |
| Sodium Hydrogensulfite | 10.0 |
| Water to make | 1 liter (pH: 5.8) |
| Bleaching Solution | |
| Potassium Ferricyanide | 30.0 |
| Potassium Bromide | 15.0 |
| Water to make | 1 liter (pH: 6.5) |

The spectrum of the cyan image formed in each film material was measured. All the film materials showed an absorption spectrum favorable to color reproduction.

Each developed film material was tested for fastness. The fastness of the film material when allowed to stand at 100° C. in a dark place for 6 days, when allowed to stand at 60° C. in a dark place of 70% RH for 6 weeks, or when exposed to light for 6 days by the use of a 100,000 lux xenon tester was measured and indicated in a rate of drop in density with the initial density as 1.0.

The results are shown in Table 1.

TABLE 1

| Sample | Coupler | 100° C., 6 Days (%) | 60° C. 70% RH 6 Weeks (%) | Light (xenon), 6 Days (%) |
|---|---|---|---|---|
| A | Coupler (1) (of the present invention) | 4 | 2 | 23 |
| B | Coupler (2)(of the present invention) | 2 | 1 | 21 |
| C | Coupler (5)(of the present invention) | 3 | 2 | 23 |
| D | Coupler (11)(of the present invention) | 6 | 3 | 22 |
| E | Coupler (101) (comparative coupler) | 10 | 5 | 35 |

It can be seen from the above results that the couplers of the present invention produce superior fastness.

EXAMPLE 2

A multilayer color light-sensitive film (Sample F) was prepared by coating the first layer (lowermost layer) to the sixth layer (uppermost layer) as described hereinafter on a cellulose triacetate support.

TABLE 2

| | Amount ($mg/m^2$) |
|---|---|
| Support | |
| Cellulose Triacetate | |
| First Layer (lowermost layer: blue-sensitive layer) | |
| Silver Iodobromide Emulsion (silver iodide: 0.2 mol %) | 100 (calculated as silver) |
| Gelatin | 2,200 |
| Yellow Coupler (*5) | 1,200 |
| Coupler Solvent (*6) | 600 |
| Second Layer | |
| Gelatin | 500 |
| Third Layer (red-sensitive layer) | |
| Silver Chlorobromide Emulsion (silver bromide: 30 mol %) | 500 (calculated as silver) |
| Gelatin | 2,900 |
| Cyan Coupler (*3) | 1,500 |
| Coupler Solvent (*4) | 700 |
| Fourth Layer | |
| Gelatin | 500 |
| Fifth Layer (green-sensitive layer) | |
| Silver Chlorobromide Emulsion (silver bromide: 30 mol %) | 500 (calculated as silver) |
| Gelatin | 1,300 |
| Magenta Coupler (*1) | 600 |
| Coupler Solvent (*2) | 110 |
| Sixth Layer (uppermost layer: protective layer) | |
| Gelatin | 750 |

*1 Magenta Coupler: 3-(2-Chloro-5-tetradecanamidoanilino)-1-(2,4,6-trichlorophenyl)-2-pyrazoline-5-one
*2 Coupler Solvent: Cresyl Phosphate
*3 Cyan Coupler: 2-(2-Chlorobenzamido)-4-chloro-5-[α-(2-chlorophenoxy)tetradecanamido]-phenol (Coupler (2) of the present invention)
*4 Coupler Solvent: Dibutyl Phthalate (60%)/2,4-Di-tert-amylphenol (40%)
*5 Yellow Coupler: α-(4-Methoxybenzoyl)-α-(3-benzyl-4-ethoxyhydanto-1-yl)-2-chloro-5-dodecyloxycarbonylacetanilide
*6 Coupler Solvent: Dibutyl Phthalate A comparative sample, Sample G, was prepared in the same manner as described above except that the cyan coupler in the third layer was replaced by an equimolar amount of Comparative Coupler (101).

Each film material was exposed through a continuous wedge to blue light, green light and red light and, thereafter, was processed in the same manner as in Example 1.

The optical density to red light of the above-developed film material was measured with the results shown in Table 3 below.

TABLE 3

| Sample | Coupler | Gamma | Maximum Density |
|---|---|---|---|
| F | Coupler (2) (of the present invention) | 3.87 | 3.38 |
| G | Coupler (101) (of the present invention) | 3.62 | 3.16 |

Each developed film material was tested for fastness. The fastness of the film material when allowed to stand at 100° C. in a dark place for 3 days, when allowed to stand at 60° C. in a dark place at 70% RH for 6 weeks, or when exposed to light for 7 days by the use of a 20,000 lux xenon tester was measured, it indicated a rate of drop in density with the initial density as 1.0. The results are shown in Table 4.

TABLE 4

| Sample | Coupler | 100° C. 3 Days (%) | 60° C. 70% RH 6 Weeks (%) | Light (xenon), 7 Days (%) |
|---|---|---|---|---|
| F | Coupler (2) (of the present invention) | 8 | 2 | 9 |
| G | Coupler (101) (comparative coupler) | 13 | 5 | 16 |

It can be seen from Table 4 that the coupler of the present invention exhibits good color-forming properties (high maximum density and high gamma), and furthermore, produces superior fastness.

While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material, comprising:

a support base having thereon:

a silver halide emulsion layer comprised of silver halide particles dispersed in a binder; and a cyan dye-forming coupler represented by general formula (I):

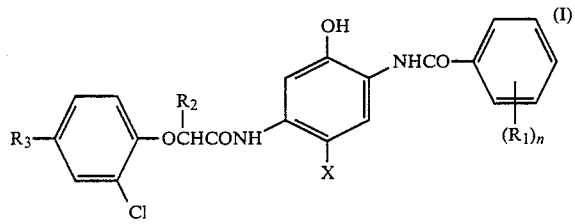

wherein $R_1$ is a hydrogen atom, a halogen atom, or an alkyl or alkoxy group having 1 to 20 carbon atoms, $R_2$ is an alkyl group having 1 to 20 carbon atoms, $R_3$ is a hydrogen atom, a halogen atom, or an alkyl group, X is a member to be released at the time of oxidative coupling with a developing agent, and n is an integer of 1 or 2.

2. A material as claimed in claim 1, wherein X is a hydrogen atom, a halogen atom, an alkoxy group having 1 to 32 carbon atoms, an aryloxy group having 6 to 32 carbon atoms, an acyloxy group, a sulfonyloxy group, an amido group, an alkoxycarbonyloxy group having 2 to 33 carbon atoms, an aryloxycarbonyloxy group having 7 to 33 carbon atoms or an imido group.

3. A material as claimed in claim 1, wherein $R_1$ is a hydrogen atom, a halogen atom, a methyl group or a methoxy group.

4. A material as claimed in claim 1, wherein $R_1$ is connected at the ortho-position when $R_1$ is not a hydrogen atom.

5. A material as claimed in claim 1, wherein $R_2$ contains 8 to 20 carbon atoms.

6. A material as claimed in claim 1, wherein $R_3$ is a hydrogen atom, a halogen atom, or a methyl group.

7. A material as claimed in claim 1, wherein X is a hydrogen atom or a chlorine atom.

8. A material as claimed in claim 1, wherein n is 1.

9. A material as claimed in claim 1, wherein $R_2$ contains 8 to 20 carbon atoms, $R_3$ is hydrogen, X is a hydrogen atom or a chlorine atom and n is 1.

10. A material as claimed in claim 1, wherein the cyan dye-forming coupler of general formula (I) is present in an amount in the range of $2\times10^{-3}$ to $5\times10^{-1}$ mole per mole of silver in the silver halide emulsion layer.

11. A material as claimed in claim 10, wherein the cyan dye-forming coupler is present in an amount in the range of $1\times10^{-2}$ to $5\times10^{-1}$ mole per mole of silver in the silver halide emulsion layer.

12. A material as claimed in claim 9, wherein the cyan dye-forming coupler is present in an amount in the range of $1\times10^{-2}$ to $5\times10^{-1}$ mole per mole of silver in the silver halide emulsion layer.

* * * * *